US010067437B2

(12) United States Patent
Ikeda et al.

(10) Patent No.: US 10,067,437 B2
(45) Date of Patent: Sep. 4, 2018

(54) ELECTROSTATIC CHARGE IMAGE DEVELOPER, PROCESS CARTRIDGE, AND IMAGE FORMING APPARATUS

(71) Applicant: FUJI XEROX CO., LTD., Tokyo (JP)

(72) Inventors: Masashi Ikeda, Kanagawa (JP); Emi Takahashi, Kanagawa (JP); Yuka Ishihara, Kanagawa (JP); Manabu Furuki, Kanagawa (JP); Makoto Kamisaki, Kanagawa (JP); Teppei Yawada, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/340,586

(22) Filed: Nov. 1, 2016

(65) Prior Publication Data

US 2017/0357171 A1 Dec. 14, 2017

(30) Foreign Application Priority Data

Jun. 10, 2016 (JP) ..... 2016-116235

(51) Int. Cl.
*G03G 9/10* (2006.01)
*G03G 21/18* (2006.01)

(52) U.S. Cl.
CPC ..... *G03G 9/10* (2013.01); *G03G 21/18* (2013.01); *G03G 21/1814* (2013.01)

(58) Field of Classification Search
CPC ..... G03G 9/09708; G03G 9/09716; G03G 9/09725
See application file for complete search history.

(56) References Cited

U.S. PATENT DOCUMENTS

2003/0190540 A1* 10/2003 Shoshi ..... C07D 209/58 430/78
2005/0233237 A1* 10/2005 Eida ..... G03G 9/081 430/108.7
2014/0219684 A1* 8/2014 Ayaki ..... G03G 9/0821 399/223

FOREIGN PATENT DOCUMENTS

JP 2013-064826 A 4/2013
JP 2013-195847 A 9/2013
JP 2015-022078 A 2/2015

* cited by examiner

*Primary Examiner* — Peter L Vajda
(74) *Attorney, Agent, or Firm* — Oliff PLC

(57) ABSTRACT

An electrostatic charge image developer includes: toner particles; silica particles treated with a silicone oil, which are externally added to the toner particles; and a carrier, wherein a volume average particle diameter of the carrier is equal to or greater than 20 μm and smaller than 30 μm, and a quantity ratio of an elemental silicon derived from a silicone oil and an elemental silicon derived from silica which are present on the surface of the carrier (silicone oil-derived elemental silicon/silica-derived elemental silicon) is in a range of 0.05 to 0.2.

13 Claims, 2 Drawing Sheets

ELECTROSTATIC CHARGE IMAGE DEVELOPER, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2016-116235 filed Jun. 10, 2016.

BACKGROUND

Technical Field

The present invention relates to an electrostatic charge image developer, a process cartridge, and an image forming apparatus.

SUMMARY

According to an aspect of the invention, there is provided an electrostatic charge image developer including:

toner particles;

silica particles treated with a silicone oil, which are externally added to the toner particles; and a carrier, wherein a volume average particle diameter of the carrier is equal to or greater than 20 μm and smaller than 30 μm, and a quantity ratio of an elemental silicon derived from a silicone oil and an elemental silicon derived from silica which are present on the surface of the carrier (silicone oil-derived elemental silicon/silica-derived elemental silicon) is in a range of 0.05 to 0.2.

BRIEF DESCRIPTION OF THE DRAWINGS

Exemplary embodiments of the present invention will be described in detail based on the following figures, wherein.

DETAILED DESCRIPTION

Figure 1:
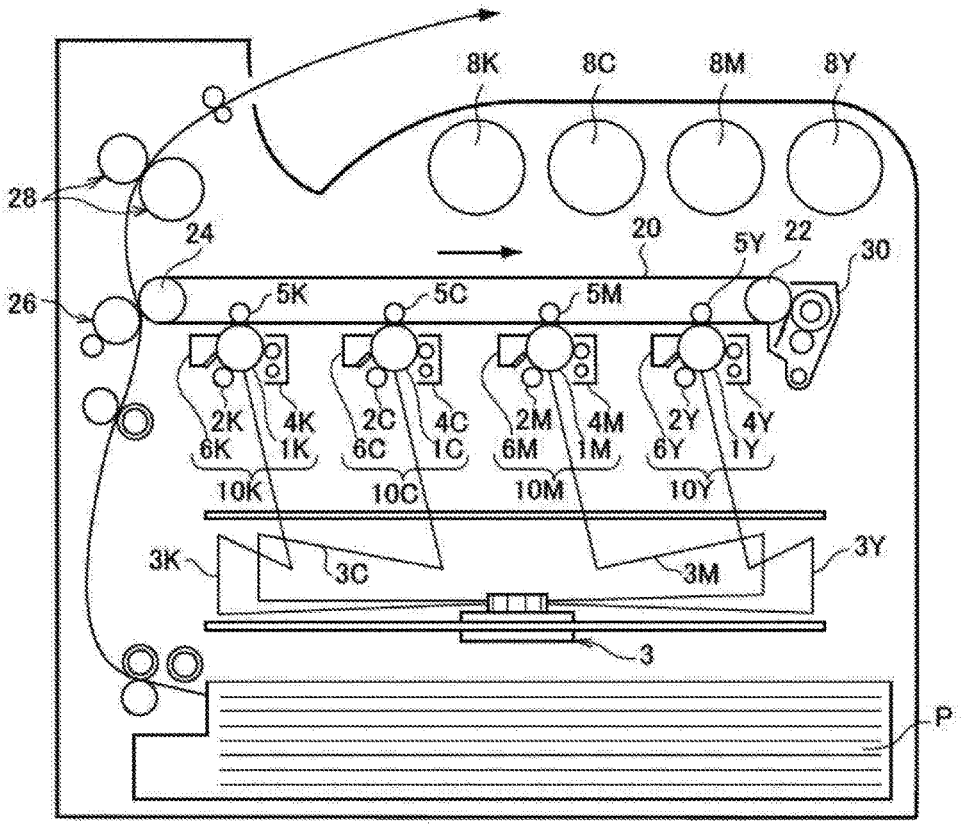
FIG. 1 is a schematic configuration diagram showing an example of an image forming apparatus according to the exemplary embodiment.

Hereinafter, exemplary embodiments of the invention will be described. The following descriptions and examples are for describing the exemplary embodiments and do not limit a scope of the invention.

Hereinafter, in a case where plural kinds of substances which fall under each component are present in the composition, an amount of each component in a composition means the total amount of the plural kinds of substances present in the composition, unless otherwise noted.

An "electrostatic charge image developer" is also simply referred to as a "developer" and silica particles subjected to surface modification with silicone oil are referred to as "silica particles surface-modified with silicone oil" or "silica particles treated with a silicone oil".

Electrostatic Charge Image Developer

A developer according to the exemplary embodiment includes toner particles, silica particles surface-treated with silicone oil which are externally added to the toner particles, and a carrier, a volume average particle diameter of the carrier is equal to or greater than 20 μm and smaller than 30 μm, and a quantity ratio of silicone oil-derived elemental silicon and silica-derived elemental silicon which are present on the surface of the carrier (silicone oil-derived/silica-derived) is in a range of 0.05 to 0.2. The quantity ratio thereof is determined by quantifying elemental silicon present on the surface of the carrier by X-ray photoelectron spectroscopy.

A quantitative method of elemental silicon present on a surface of a carrier performed by X-ray photoelectron spectroscopy (XPS) will be described.

Since silicon atoms configuring silicone oil and silicon atoms configuring silica have different chemical bonding states, plural peaks appear in XPS spectra of 2p orbital of elemental silicon. The attribution of each peak (that is, the fact whether the peak is a peak of silicon atoms configuring silicone oil or a peak of silicon atoms configuring silica) is specified by a position of a chemical shift of each peak. An area strength of each peak is determined, a value of {area strength of peak derived from silicone oil/area strength of peak derived from silica} is determined, and this is set as the "quantity ratio of the silicone oil-derived elemental silicon to the silica-derived elemental silicon present on the surface of the carrier".

The developer according to the exemplary embodiment prevents formation of streaky image defects extending in a transportation direction of a recording medium. The reason thereof is not clear, but is assumed as follows.

At least some external additives of a toner are isolated from the toner particles on an image holding member and aggregated in a front portion where a region of the cleaning blade which contacts with the image holding member (referred to as a "blade nip") to form an aggregate layer (referred to as an "external additive dam"), and the passing of the toner particles from the blade nip is prevented. When the external additive dam having high aggregating properties is not formed, the passing of the toner particles from the blade nip occurs to cause formation of streaky image defects extending in a transportation direction of a recording medium.

With respect to this, it is assumed that the developer according to the exemplary embodiment prevents formation of streaky image defects extending in a transportation direction of a recording medium by satisfying the following conditions (a), (b), and (c).

(a) Silica particles surface-treated with silicone oil are externally added to toner particles.

Silica particles are widely used as an external additive of a toner and the silica particles are subjected to surface-modification with silicone oil for hydrophobization and used. The silica particles surface-treated with silicone oil are easily aggregated to each other due to attachment of silicone oil to the surfaces of the silica particles, and the external additive dam having high aggregating properties is formed. Accordingly, formation of streaky image defects which may be formed with the mechanism described above is assumed to be prevented.

(b) A volume average particle diameter of a carrier is smaller than 30 μm.

In a developing device in which a carrier and a toner are agitated and mixed, an external additive of the toner may receive an external force from the carrier to be embedded in the toner particles. When a particle diameter of the carrier increases, the external additive highly tends to be embedded in the toner particles. When the volume average particle diameter of the carrier is smaller than 30 μm, the silica particles are prevented from being embedded in the toner particles due to agitation in the developing device and the silica particles are easily isolated from the toner particles on the image holding member, in comparison to a case where the volume average particle diameter of the carrier equal to or greater than 30 μm. The silica particles surface-treated with silicone oil which are isolated from the toner particles form an external additive dam having high aggregating properties, and accordingly, streaky image defects which may be formed with the mechanism described above are assumed to be prevented.

The volume average particle diameter of the carrier is equal to or greater than 20 μm, from viewpoints of agitating properties in a developing device, stability of charging performance, and toner transporting properties.

(c) A quantity ratio of silicone oil-derived elemental silicon and silica-derived elemental silicon which are present on a surface of a carrier (silicone oil-derived/silica-derived) is in a range of 0.05 to 0.2.

In a process of mixing and agitating a toner to which silica particles are externally added, and a carrier to prepare the developer, some silica particles are isolated from the toner particles to be attached to the surface of the carrier. Elemental silicon present on the surface of the carrier mainly derived from the silica particles attached to the surface of the carrier. The quantity ratio of the silicone oil-derived elemental silicon to the silica-derived elemental silicon present on the surface of the carrier reflects an amount of silica particles surface-treated with silicone oil which are isolated from the toner particles and attached to the surface of the carrier and the amount reflect an amount of the silica particles surface-treated with silicone oil which are externally added to the toner particles and a degree of ease of isolation of the silica particles surface-treated with silicone oil from the toner particles. Accordingly, the quantity ratio of the silicone oil-derived elemental silicon to the silica-derived elemental silicon present on the surface of the carrier in the developer is an index of the amount of the silica particles surface-treated with silicone oil isolated from the toner particles and present on the image holding member. When the quantity ratio of the elemental silicon is in a range of 0.05 to 0.2, the silica particles surface-treated with silicone oil which are isolated from the toner particles and present on the image holding member are balanced, and in this case, the silica particles surface-treated with silicone oil form an external additive dam having high aggregating properties, and streaky image defects formed due to the mechanism described above are assumed to be prevented.

The quantity ratio of the silicone oil-derived elemental silicon to the silica-derived elemental silicon present on the surface of the carrier (silicone oil-derived/silica-derived) is more preferably 0.05 to 0.18.

The quantity ratio of the silicone oil-derived elemental silicon to the silica-derived elemental silicon present on the surface of the carrier is, for example, controlled by adhesion strength of the silica particles surface-treated with silicone oil to the toner or a ratio of an external addition amount of the above silica particles and that of silica particles used in combination. In addition, a degree of ease of isolation of the silica particles surface-treated with silicone oil and the silica particles used in combination from the toner particles is adjusted by a particle diameter of both of the silica particles or a viscosity of silicone oil attached to the silica particles surface-treated with silicone oil (that is, silicone oil used for surface modification of silica particles) to control the quantity ratio of the elemental silicon.

Hereinafter, constituent elements configuring the developer according to the exemplary embodiment and components contained in the constituent elements will be described.

Toner Particles

The toner particles, for example, include a binder resin, and if necessary, a colorant, and a release agent, and other additives.

Binder Resin

Examples of the binder resin include vinyl resins formed of homopolymers of monomers such as styrenes (for example, styrene, parachlorostyrene, and α-methylstyrene), (meth)acrylates (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (for example, acrylonitrile and methacrylonitrile), vinyl ethers (for example, vinyl methyl ether and vinyl isobutyl ether), vinyl ketones (for example, vinyl methyl ketone, vinyl ethyl ketone, and vinyl isopropenyl ketone), and olefins (for example, ethylene, propylene, and butadiene), or copolymers obtained by combining two or more kinds of these monomers.

Examples of the binder resin also include a non-vinyl resin such as an epoxy resin, a polyester resin, a polyurethane resin, a polyamide resin, a cellulose resin, a polyether resin, and modified rosin, mixtures thereof with the above-described vinyl resin, or graft polymer obtained by polymerizing a vinyl monomer in the coexistence of such non-vinyl resins.

These binder resins may be used alone or in combination of two or more kinds thereof.

As the binder resin, a polyester resin is suitable. Examples of the polyester resin include polycondensates of polyvalent carboxylic acids and polyols.

Examples of the polyvalent carboxylic acid include aliphatic dicarboxylic acids (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (for example, cyclohexanedicarboxylic acid), aromatic dicarboxylic acids (for example, terephthalic acid, isophthalic acid, phthalic acid, and naphthalenedicarboxylic acid), anhydrides thereof, or lower alkyl esters (having, for example, 1 to 5 carbon atoms) thereof. Among these, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination together with a dicarboxylic acid. Examples of the tri- or higher-valent carboxylic acid include trimellitic acid, pyromellitic acid, anhydrides thereof, or lower alkyl esters (having, for example, 1 to 5 carbon atoms) thereof.

The polyvalent carboxylic acids may be used alone or in combination of two or more kinds thereof.

Examples of the polyol include aliphatic diols (for example, ethylene glycol, diethylene glycol, triethylene glycol, propylene glycol, butanediol, hexanediol, and neopentyl glycol), alicyclic diols (for example, cyclohexanediol, cyclohexanedimethanol, and hydrogenated bisphenol A), and aromatic diols (for example, ethylene oxide adduct of bisphenol A and propylene oxide adduct of bisphenol A). Among these, for example, aromatic diols and alicyclic diols are preferably used, and aromatic diols are more preferably used as the polyol.

As the polyol, a tri- or higher-valent polyol employing a crosslinked structure or a branched structure may be used in combination together with a diol. Examples of the tri- or higher-valent polyol include glycerin, trimethylolpropane, and pentaerythritol.

The polyols may be used alone or in combination of two or more kinds thereof.

The glass transition temperature (Tg) of the polyester resin is preferably 50° C. to 80° C., and more preferably 50° C. to 65° C.

The glass transition temperature is determined by a DSC curve obtained by differential scanning calorimetry (DSC), and more specifically, is determined by "Extrapolated Starting Temperature of Glass Transition" disclosed in a method of determining a glass transition temperature of JIS K 7121-1987 "Testing Methods for Transition Temperature of Plastics".

The weight average molecular weight (Mw) of the polyester resin is preferably 5,000 to 1,000,000 and more preferably 7,000 to 500,000. The number average molecular weight (Mn) of the polyester resin is preferably 2,000 to 100,000. The molecular weight distribution Mw/Mn of the polyester resin is preferably 1.5 to 100 and more preferably 2 to 60.

The weight average molecular weight and the number average molecular weight are measured by gel permeation chromatography (GPC). The molecular weight measurement by GPC is performed by using HLC-8120 GPC which is a GPC manufactured by Tosoh Corporation as a measuring device, TSKGEL SUPERHM-M (15 cm) which is a column manufactured by Tosoh Corporation, and a THF solvent. The weight average molecular weight and the number average molecular weight are calculated using a calibration curve of molecular weight obtained with a monodisperse polystyrene standard sample from the measurement results obtained from the measurement.

A well-known preparing method is applied to prepare the polyester resin. Specific examples thereof include a method of conducting a reaction at a polymerization temperature set to 180° C. to 230° C., if necessary, under reduced pressure in the reaction system, while removing water or an alcohol generated during condensation.

In the case in which monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. In the case in which a monomer having poor compatibility is present, the monomer having poor compatibility and an acid or an alcohol to be polycondensed with the monomer may be previously condensed and then polycondensed with the main component.

The content of the binder resin is, for example, preferably 40% by weight to 95% by weight, more preferably 50% by weight to 90% by weight, and even more preferably 60% by weight to 85% by weight with respect to the total amount of the toner particles.

Colorant

Examples of the colorant include pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate; and dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used alone or in combination of two or more kinds thereof.

As the colorant, the surface-treated colorant may be used, if necessary. The colorant may be used in combination with a dispersing agent. Plural colorants may be used in combination.

The content of the colorant is preferably 1% by weight to 30% by weight, more preferably 3% by weight to 15% by weight with respect to the total amount of the toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

The melting temperature of the release agent is preferably 50° C. to 110° C. and more preferably 60° C. to 100° C.

The melting temperature is obtained from "melting peak temperature" described in the method of obtaining a melting temperature in JIS K 7121-1987 "Testing Methods for Transition Temperatures of Plastics", from a DSC curve obtained by differential scanning calorimetry (DSC).

The content of the release agent is, for example, preferably 1% by weight to 20% by weight, and more preferably 5% by weight to 15% by weight with respect to the total amount of the toner particles.

Other Additives

Examples of other additives include well-known additives such as a magnetic material, a charge-controlling agent, and an inorganic powder. The toner particles include these additives as internal additives.

Characteristics of Toner Particles

The toner particles may be toner particles having a single-layer structure, or toner particles having a so-called core/shell structure composed of a core (core particle) and a coating layer (shell layer) coated on the core. The toner particles having a core/shell structure is composed of, for example, a core containing a binder resin, and if necessary, other additives such as a colorant and a release agent and a coating layer containing a binder resin.

A volume average particle diameter (D50v) of the toner particles is preferably 2 μm to 10 μm, more preferably 2.5 μm to 8.0 μm, even more preferably 3.0 μm to 6.0 μm, and further more preferably 3.8 μm to 5.0 μm.

Various average particle diameters and various particle size distribution indices of the toner particles are measured using a COULTERMULTISIZER II (manufactured by Beckman Coulter, Inc.) and ISOTON-II (manufactured by Beckman Coulter, Inc.) as an electrolyte.

In the measurement, 0.5 mg to 50 mg of a measurement sample is added to 2 ml of a 5 weight % aqueous solution of surfactant (preferably sodium alkylbenzene sulfonate) as a dispersing agent. The obtained material is added to 100 ml to 150 ml of the electrolyte.

The electrolyte in which the sample is suspended is subjected to a dispersion treatment using an ultrasonic disperser for 1 minute, and a particle size distribution of particles having a particle diameter of 2 μInto 60 μm is measured by a COULTER MULTISIZER II using an aperture having an aperture diameter of 100 μm. 50,000 particles are sampled.

Cumulative distributions by volume and by number are drawn from the side of the smallest diameter with respect to particle size ranges (channels) divided based on the measured particle size distribution. The particle diameter when the cumulative percentage becomes 16% is defined as that corresponding to a volume particle diameter D16v and a number particle diameter D16p, while the particle diameter when the cumulative percentage becomes 50% is defined as that corresponding to a volume average particle diameter D50v and a number average particle diameter D50p. Furthermore, the particle diameter when the cumulative percentage becomes 84% is defined as that corresponding to a volume particle diameter D84v and a number particle diameter D84p.

Using these, a volume particle size distribution index (GSDv) is calculated as $(D84v/D16v)^{1/2}$, while a number particle size distribution index (GSDp) is calculated as $(D84p/D16p)^{1/2}$.

A shape factor SF1 of the toner particles is preferably 110 to 150, and more preferably 120 to 140.

The shape factor SF1 is obtained through the following expression.

$$SF1=(ML^2/A)\times(\pi/4)\times 100 \quad \text{Expression:}$$

In the foregoing expression, ML represents an absolute maximum length of a toner, and A represents a projected area of a toner.

Specifically, the shape factor SF1 is numerically converted mainly by analyzing a microscopic image or a scanning electron microscope (SEM) image by using an image analyzer, and is calculated as follows. That is, an optical microscopic image of particles scattered on a surface of a glass slide is input to an image analyzer LUZEX through a video camera to obtain maximum lengths and projected areas of 100 particles, values of SF1 are calculated through the foregoing expression, and an average value thereof is obtained.

Preparing Method of Toner Particles

The toner particles may be prepared using any of a dry preparing method (e.g., kneading and pulverizing method) and a wet preparing method (e.g., aggregation and coalescence method, suspension and polymerization method, and dissolution and suspension method). The preparing method is not particularly limited to these preparing methods, and a known preparing method is employed. Among these, the toner particles may preferably be obtained by the aggregation and coalescence method.

Specifically, for example, when the toner particles are prepared by an aggregation and coalescence method, the toner particles are prepared through the processes of: preparing a resin particle dispersion in which resin particles as a binder resin are dispersed (resin particle dispersion preparation process); aggregating the resin particles (if necessary, other particles) in the resin particle dispersion (if necessary, in the dispersion after mixing with other particle dispersions) to form aggregated particles (aggregated particle forming process); and heating the aggregated particle dispersion in which the aggregated particles are dispersed, to coalesce the aggregated particles, thereby forming toner particles (coalescence process).

Hereinafter, each of the processes will be described below in detail.

In the following description, a method of obtaining toner particles containing a colorant and a release agent will be described, but a colorant and a release agent are used, if necessary. Other additives may be used of course, other than a colorant and a release agent.

Resin Particle Dispersion Preparation Process

For example, a colorant particle dispersion in which colorant particles are dispersed and a release agent particle dispersion in which release agent particles are dispersed are prepared together with a resin particle dispersion in which resin particles as a binder resin are dispersed.

The resin particle dispersion is prepared by, for example, dispersing resin particles by a surfactant in a dispersion medium.

Examples of the dispersion medium used for the resin particle dispersion include aqueous mediums.

Examples of the aqueous mediums include water such as distilled water and ion exchange water, and alcohols. These may be used alone or in combination of two or more kinds thereof.

Examples of the surfactant include anionic surfactants such as sulfuric ester salt, sulfonate, phosphate, and soap anionic surfactants; cationic surfactants such as amine salt and quaternary ammonium salt cationic surfactants; and nonionic surfactants such as polyethylene glycol, alkyl phenol ethylene oxide adduct, and polyol nonionic surfactants. Among these, anionic surfactants and cationic surfactants are particularly used. Nonionic surfactants may be used in combination with anionic surfactants or cationic surfactants.

The surfactants may be used alone or in combination of two or more kinds thereof.

Regarding the resin particle dispersion, as a method of dispersing the resin particles in the dispersion medium, a common dispersing method using, for example, a rotary shearing-type homogenizer, or a ball mill, a sand mill, or a DYNO MILL having media is exemplified. Depending on the kind of the resin particles, resin particles may be dispersed in the dispersion medium by a phase inversion emulsification method. The phase inversion emulsification method includes: dissolving a resin to be dispersed in a hydrophobic organic solvent in which the resin is soluble; conducting neutralization by adding abase to an organic continuous phase (O phase); and performing phase inversion of the resin from W/O to O/W by putting an aqueous medium (W phase), thereby dispersing the resin as particles in the aqueous medium.

A volume average particle diameter of the resin particles dispersed in the resin particle dispersion is, for example, preferably 0.01 μm to 1 μm, more preferably 0.08 μm to 0.8 μm, and even more preferably 0.1 μm to 0.6 μm.

Regarding the volume average particle diameter of the resin particles, a cumulative distribution by volume is drawn from the side of the smallest diameter with respect to particle size ranges (channels) divided using the particle size distribution obtained by the measurement by a laser diffraction-type particle size distribution measuring device (for example, LA-700 manufactured by Horiba, Ltd.), and a particle diameter when the cumulative percentage becomes 50% with respect to the entirety of the particles is measured as a volume average particle diameter D50v. The volume average particle diameter of the particles in other dispersions is also measured in the same manner.

The content of the resin particles contained in the resin particle dispersion is, for example, preferably 5% by weight to 50% by weight, and more preferably 10% by weight to 40% by weight.

For example, the colorant particle dispersion and the release agent particle dispersion are also prepared in the same manner as in the case of the resin particle dispersion. That is, the particles in the resin particle dispersion are the same as the colorant particles dispersed in the colorant particle dispersion and the release agent particles dispersed in the release agent particle dispersion, in terms of the volume average particle diameter, the dispersion medium, the dispersing method, and the content of the particles.

Aggregated Particle Forming Process

Next, the resin particle dispersion, the colorant particle dispersion, and the release agent particle dispersion are mixed with each other.

The resin particles, the colorant particles, and the release agent particles are heterogeneously aggregated in the mixed dispersion, thereby forming aggregated particles having a diameter near a target toner particle diameter and including the resin particles, the colorant particles, and the release agent particles.

Specifically, for example, an aggregating agent is added to the mixed dispersion and a pH of the mixed dispersion is adjusted to acidity (for example, the pH is 2 to 5). If necessary, a dispersion stabilizer is added. Then, the mixed dispersion is heated at a temperature close to the glass transition temperature of the resin particles (specifically, for example, from a temperature 30° C. lower than the glass transition temperature of the resin particles to a temperature 10° C. lower than the glass transition temperature) to aggregate the particles dispersed in the mixed dispersion, thereby forming the aggregated particles.

In the aggregated particle forming process, for example, the aggregating agent may be added at room temperature (for example, 25° C.) under stirring of the mixed dispersion using a rotary shearing-type homogenizer, the pH of the mixed dispersion may be adjusted to be acidic (for example, the pH is 2 to 5), a dispersion stabilizer may be added if necessary, and then the heating may be performed.

Examples of the aggregating agent include a surfactant having an opposite polarity to the polarity of the surfactant contained in the mixed dispersion, inorganic metal salts and di- or higher-valent metal complexes. In a case where a metal complex is used as the aggregating agent, the amount of the surfactant used is reduced and charging characteristics are improved.

If necessary, an additive may be used which forms a complex or a similar bond with the metal ions of the aggregating agent, together with the aggregating agent. A chelating agent is preferably used as the additive.

Examples of the inorganic metal salts include metal salts such as calcium chloride, calcium nitrate, barium chloride, magnesium chloride, zinc chloride, aluminum chloride, and aluminum sulfate, and inorganic metal salt polymers such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid, and aminocarboxylic acid such as iminodiacetic acid (IDA), nitrilotriacetic acid (NTA), and ethylenediaminetetraacetic acid (EDTA).

The amount of the chelating agent added is preferably 0.01 parts by weight to 5.0 parts by weight, and more preferably 0.1 parts by weight and less than 3.0 parts by weight with respect to 100 parts by weight of the resin particles.

Coalescence Process

Next, the aggregated particle dispersion in which the aggregated particles are dispersed is heated at, for example, a temperature that is equal to or higher than the glass transition temperature of the resin particles (for example, a temperature that is higher than the glass transition temperature of the resin particles by 10° C. to 30° C.) to coalesce the aggregated particles and form toner particles.

Toner particles are obtained through the foregoing processes.

Toner particles may be prepared through the processes of: after the aggregated particle dispersion in which the aggregated particles are dispersed is obtained, further mixing the resin particle dispersion in which the resin particles are dispersed with the aggregated particle dispersion to conduct aggregation so that the resin particles further adhere to the surfaces of the aggregated particles, thereby forming second aggregated particles; and coalescing the second aggregated particles by heating the second aggregated particle dispersion in which the second aggregated particles are dispersed, thereby forming toner particles having a core/shell structure.

After the coalescence process ends, the toner particles formed in the solution are subjected to a washing process, a solid-liquid separation process, and a drying process, that are well known, and thus dried toner particles are obtained. In the washing process, preferably, displacement washing using ion exchange water may be sufficiently performed from a viewpoint of charging properties. In the solid-liquid separation process, suction filtration, pressure filtration, or the like may preferably be performed from a viewpoint of productivity. In the drying process, freeze drying, flash drying, fluidized drying, vibration-type fluidized drying, or the like may preferably be performed from a viewpoint of productivity.

Silica Particles Surface-Treated with Silicone Oil

The silica particles surface-treated with silicone oil are particles obtained by performing surface modification of silica particles such as fumed silica or colloidal silica with silicone oil. Silicone oil is attached to the surface of the silica particles surface-treated with silicone oil.

Examples of silicone oil used for surface modification of the silica particles include dialkyl polysiloxane such as dimethyl polysiloxane, diethyl polysiloxane, or dipropyl polysiloxane; phenyl-modified polysiloxane obtained by substituting a part of a branch of dialkyl polysiloxane with a phenyl group; and fluoroalkyl-modified polysiloxane obtained by substituting a part of a branch of dialkyl polysiloxane with a fluoroalkyl group. Silicone oil may be used alone or in combination of two or more kinds thereof. A kinematic viscosity (25° C.) of silicone oil is preferably 10 $mm^2/s$ to 70 $mm^2/s$ and more preferably 25 $mm^2/s$ to 60 $mm^2/s$.

Examples of a treatment method for performing surface modification of silica particles with silicone oil include a spraying method of spraying silicone oil or a solution containing silicone oil to silica particles in a gas phase; a dipping method of dipping silica particles in silicone oil or a solution containing silicone oil; and a mixing method of mixing silicone oil or a solution containing silicone oil and silica particles with each other by using a mixing device.

A number average particle diameter of the silica particles surface-treated with silicone oil is preferably 10 nm to 50 nm, more preferably 20 nm to 45 nm, and even more preferably 30 nm to 40 nm, from a viewpoint of a degree of ease of isolation from toner particles and a viewpoint of aggregating properties of an external additive dam.

An amount of the silica particles surface-treated with silicone oil externally added is preferably 0.1 parts by weight to 3.0 parts by weight, more preferably 0.3 parts by weight to 2.5 parts by weight, and even more preferably 0.5 parts by weight to 2.0 parts by weight with respect to 100 parts by weight of toner particles.

Silica Particles Usable in Combination (Second Silica Particles)

The silica particles usable in combination may be silica particles subjected to surface modification with oil other than silicone oil (for example, paraffin oil or fluorine oil), but silica particles which are not subjected to surface modification with any of oil are preferable. That is, the silica particles usable in combination are preferably silica particles having the surface to which oil is not attached.

The silica particles having the surface to which oil is not attached have low aggregating properties in comparison to the silica particles surface-treated with silicone oil, and accordingly, it is assumed that the silica particles are not incorporated into an external additive dam or easily isolated from an external additive dam, and pass through the blade nip little by little to cause reduction in friction between the cleaning blade and the image holding member. Therefore, it is assumed that a damage on the cleaning blade is prevented, the passing of some toner particles or a part of the aggregated external additive dam from the blade nip is prevented, and formation of color streaks or white streaks extending in a transportation direction of a recording medium is prevented.

The silica particles usable in combination may be silica particles having a hydrophobized surface. Examples of a hydrophobizing agent of the silica particles include hexamethyldisilazane and silane compounds such as diethoxydimethylsilane, dimethoxy diphenyl silane, and dimethyldichlorosilane.

A number average particle diameter of the silica particles usable in combination is preferably 50 nm to 200 nm. When the number average particle diameter thereof is equal to or greater than 50 nm, an operation of a lubricant that reduces friction between a cleaning blade and an image holding member is easily exhibited, and when the number average particle diameter thereof is equal to or smaller than 200 nm, the surface of the image holding member is hardly damaged.

From the viewpoints described above, the number average particle diameter of the silica particles usable in combination is more preferably 80 nm to 200 nm and even more preferably 90 nm to 150 nm.

A shape factor SF2 of the silica particles usable in combination is preferably 100 to 125, more preferably 100 to 120, and even more preferably 100 to 110. When the shape factor SF2 thereof is in the range described above, an operation of a lubricant that reduces friction between a cleaning blade and an image holding member is easily exhibited.

An amount of the silica particles usable in combination externally added is preferably 1.0 part by weight to 3.5 parts by weight, more preferably 1.5 parts by weight to 3.0 parts by weight, and even more preferably 2.0 parts by weight to 2.5 parts by weight, with respect to 100 parts by weight of toner particles.

From a viewpoint of controlling the quantity ratio of the silicone oil-derived elemental silicon to the silica-derived elemental silicon which are present on the surface of the carrier to be in a range of 0.05 to 0.2, a ratio of external addition amounts of the silica particles surface-modified with silicone oil and the silica particles usable in combination (weight ratio, treated:usable in combination) is preferably 4:1 to 1:4, more preferably 7:3 to 3:7, and even more preferably 3:2 to 2:3.

The number average particle diameter of the silica particles is 50% diameter (D50p) of cumulative frequency of a sphere equivalent diameter obtained by obtained by observing 100 primary particles of silica particles in a state where the silica particles are externally added to the toner particles by using a scanning electron microscope (SEM) and by image analysis of primary particles.

The shape factor SF2 of the silica particles is an average value of values calculated by the following expression from perimeters and projected areas obtained by observing 100 primary particles of silica particles in a state where the silica particles are externally added to the toner particles by using the SEM and by image analysis of the primary particles.

$$SF2=\{PM^2/(4\pi A)\}\times 100 \quad \text{Expression:}$$

In the foregoing expression, PM represents a perimeter of silica particles and A represents a projected area of silica particles.

Other External Additives

In the exemplary embodiment, external additives other than the silica particles surface-treated with silicone oil and the silica particles usable in combination may be externally added to the toner particles. However, in the exemplary embodiment, substantially only the silica particles surface-treated with silicone oil and the silica particles usable in combination are preferably externally added to the toner particles.

Examples of the other external additives include inorganic particles formed of $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $K_2O.(TiO_2)n$, $CaCO_3$, $MgCO_3$, $BaSO_4$, and $MgSO_4$. The surfaces of the inorganic particles may be treated with a hydrophobizing agent.

Carrier

The carrier is not particularly limited and known carriers are exemplified. Examples of the carrier include a resin coated carrier in which surfaces of cores formed of a magnetic powder are coated with a resin; a magnetic powder dispersion-type carrier in which a magnetic powder is dispersed and blended in a matrix resin; a resin impregnation-type carrier in which a porous magnetic powder is impregnated with a resin; and a carrier in which a magnetic powder dispersion-type carrier or a resin impregnation-type carrier is set as a core and the surface of the core is coated with a resin.

Examples of the magnetic powder include magnetic metals such as iron, nickel, and cobalt, and magnetic oxides such as ferrite and magnetite. Particularly, ferrite is preferable which contains Mn and Mg having a small variation in a magnetic force even when used for carriers having a small diameter, and Mn—Mg—Sr ferrite and Mn—Mg—Ca ferrite are preferably used.

Examples of the resin for coating and matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid ester copolymer, an acrylic resin, a straight silicone resin configured to include an organosiloxane bond or a modified product thereof, a fluororesin, polyester, polycarbonate, a phenol resin, and an epoxy resin. The resin for coating and the matrix resin may contain additives such as conductive particles. Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

A coating method using a coating layer forming solution in which a resin for coating and various additives (used if necessary) are dissolved in an appropriate solvent is used to coat the surface of a core with the resin. The solvent is not particularly limited and may be selected in consideration of the type of the resin to be used, coating suitability, and the like. Specific examples of the resin coating method include a dipping method of dipping cores in a coating layer forming solution; a spraying method of spraying a coating layer forming solution to surfaces of cores; a fluid bed method of spraying a coating layer forming solution in a state in which cores are allowed to float by flowing air; and a kneader-coater method in which cores of a carrier and a coating layer forming solution are mixed with each other in a kneader-coater and the solvent is removed. In the exemplary embodiment, a carrier in which a core formed of ferrite is coated with a resin is particularly preferably used.

A volume average particle diameter of the carrier is smaller than 30 μm, more preferably equal to or smaller than 29 μm, and even more preferably equal to or smaller than 27 μm, from a viewpoint of preventing formation of streaky image defects extending in a transportation direction of a recording medium. Meanwhile, the volume average particle diameter of the carrier is equal to or greater than 20 μm, more preferably equal to or greater than 23 μm, and even more preferably equal to or greater than 25 μm, from viewpoints of agitating properties in a developing device, stability of charging performance, and toner transporting properties.

The volume average particle diameter of the carrier is measured by using a laser diffraction scattering type particle size distribution measuring device (for example, LS 13 320 manufactured by Beckman Coulter, Inc.). The volume average particle diameter of the carrier contained in the developer is measured by blowing off toner from the developer to isolate the carrier.

The developer according to the exemplary embodiment is, for example, prepared by preparing an externally added toner by externally adding the silica particles surface-treated with silicone oil and the silica particles usable in combination to dried toner particles and mixing this externally added toner and a carrier with each other. A ratio of mixing (weight ratio) between the externally added toner and the carrier is preferably 1:100 to 30:100 and more preferably 3:100 to 20:100 (externally added toner:carrier).

Image Forming Apparatus and Image Forming Method

An image forming apparatus and an image forming method according to the exemplary embodiment will be described.

An image forming apparatus according to the exemplary embodiment includes an image holding member, a charging unit that charges a surface of the image holding member, an electrostatic charge image forming unit that forms an electrostatic charge image on the charged surface of the image holding member, a developing unit that contains an electrostatic charge image developer and develops the electrostatic charge image formed on the surface of the image holding member with the electrostatic charge image developer as a toner image, a transfer unit that transfers the toner image formed on the surface of the image holding member to a surface of a recording medium, a fixing unit that fixes the toner image transferred onto the surface of the recording medium, and a cleaning unit that includes a blade which contacts with the surface of the image holding member and cleans the surface of the image holding member with the blade after the toner image is transferred onto the surface of the recording medium. As the electrostatic charge image developer, the electrostatic charge image developer according to the exemplary embodiment is applied.

In the image forming apparatus according to the exemplary embodiment, an image forming method (image forming method according to the exemplary embodiment) including the processes of: charging a surface of an image holding member; forming an electrostatic charge image on the charged surface of the image holding member; developing the electrostatic charge image formed on the surface of the image holding member with the electrostatic charge image developer according to the exemplary embodiment as a toner image; transferring the toner image formed on the surface of the image holding member to a surface of a recording medium; fixing the toner image transferred onto the surface of the recording medium; and contacting a blade with the surface of the image holding member after the toner image is transferred to clean the surface of the image holding member is performed.

As the charging unit included in the image forming apparatus according to the exemplary embodiment, a contact type charging unit using a conductive member which contacts with a surface of an image holding member and a non-contact type charging unit using corona discharge are used, for example. The contact type charging unit may use any of a method of applying only a DC voltage to a conductive member and a method of applying a voltage obtained by superimposing an AC voltage on a DC voltage to a conductive member. As the charging unit, a non-contact type charging unit is more preferably used than a contact type charging unit, from a viewpoint of preventing formation of streaky image defects.

By applying the electrostatic charge image developer according to the exemplary embodiment, the image forming apparatus according to the exemplary embodiment prevents streaky image defects extending in a transportation direction of a recording medium, even in a case where a charging unit which charges a surface of an image holding member by a contact method is used. Regarding the contact type charging unit, a method of applying a voltage obtained by superimposing an AC voltage on a DC voltage to a conductive member is more preferable than a method of applying only a DC voltage to a conductive member, from a viewpoint of preventing formation of streaky image defects.

As the image forming apparatus according to the exemplary embodiment, a known image forming apparatus is applied, such as a direct transfer type apparatus that directly transfers a toner image formed on a surface of an image holding member onto a recording medium; an intermediate transfer type apparatus that primarily transfers a toner image formed on a surface of an image holding member onto a surface of an intermediate transfer member, and secondarily transfers the toner image transferred to the surface of the intermediate transfer member onto a surface of a recording medium; or an apparatus that is provided with an erasing unit that irradiates, after transfer of a toner image and before charging, a surface of an image holding member with erasing light for erasing.

In a case where the image forming apparatus according to the exemplary embodiment is an intermediate transfer type apparatus, a transfer unit is configured to have, for example, an intermediate transfer member having a surface to which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to the exemplary embodiment, a portion including the developing unit may have, for example, a cartridge structure (process cartridge) detachable from an image forming apparatus. As the process cartridge, a process cartridge including a container that contains the electrostatic charge image developer according to the exemplary embodiment, and a developing unit is suitably used, for example.

Hereinafter, an example of the image forming apparatus according to the exemplary embodiment will be described. However, the image forming apparatus is not limited thereto. In the following descriptions, main portions shown in the drawing will be described and descriptions of other portions will be omitted.

FIG. 1 is a schematic configuration diagram showing the image forming apparatus according to the exemplary embodiment.

The image forming apparatus shown in FIG. 1 is provided with first to fourth electrophotographic image forming units 10Y, 10M, 10C, and 10K (image forming units) that output yellow (Y), magenta (M), cyan (C), and black (K) images based on color-separated image data, respectively. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt (an example of an intermediate transfer member) 20 is installed above the units 10Y, 10M, 10C, and 10K to extend through the units. The intermediate transfer belt 20 is wound on a driving roll 22 and a support roll 24 and travels in a direction toward the fourth unit 10K from the first unit 10Y. The support roll 24 is pressed in a direction in which it departs from the driving roll 22 by a spring or the like (not shown), and a tension is given to the intermediate transfer belt 20 wound on both of the rolls. In addition, an intermediate transfer member cleaning device 30 is provided to be opposed to the driving roll 22 on a surface of the intermediate transfer belt 20 on the image holding member side.

Developing devices (an example of developing units) 4Y, 4M, 4C, and 4K of the units 10Y, 10M, 10C, and 10K are connected to toner cartridges 8Y, 8M, 8C, and 8K corresponding to the respective colors via toner supply tubes (not shown). Yellow, magenta, cyan, and black toners contained in the toner cartridges 8Y, 8M, 8C, and 8K are supplied to the developing devices 4Y, 4M, 4C, and 4K, respectively. Each of the toner cartridges 8Y, 8M, 8C, and 8K is detachable from the image forming apparatus and, in a case where the toner contained in the toner cartridge runs low, the toner cartridge is replaced.

The first to fourth units 10Y, 10M, 10C, and 10K have the same configuration and perform the same operation, and accordingly, the first unit 10Y that is disposed on the upstream side in a traveling direction of the intermediate transfer belt and forms a yellow image will be representatively described here.

The first unit 10Y has a photoreceptor 1Y acting as an image holding member. Around the photoreceptor 1Y, a charging roll (an example of the charging unit) 2Y that charges a surface of the photoreceptor 1Y to a predetermined potential, an exposure device (an example of the electrostatic charge image forming unit) 3 that exposes the charged surface with laser beams 3Y based on a color-separated image signal to form an electrostatic charge image, a developing device (an example of the developing unit) 4Y that supplies a charged toner to the electrostatic charge image to develop the electrostatic charge image, a primary transfer roll (an example of the primary transfer unit) 5Y that transfers the developed toner image onto the intermediate transfer belt 20, and a photoreceptor cleaning device (an example of the cleaning unit) 6Y that removes the toner remaining on the surface of the photoreceptor 1Y after primary transfer, are arranged in sequence.

The charging roll 2Y is a conductive roll that contacts with a circumference surface of the photoreceptor 1Y to charge the circumference surface of the photoreceptor 1Y. Only a DC voltage or a voltage obtained by superimposing an AC voltage on a DC voltage is applied to the charging roll 2Y from a power source. The image forming apparatus may include a contact-type charger such as a charge brush, a charge film, a charge rubber blade, or a charge tube or a non-contact type charger such as a scoroton charger or a corotron charger, instead of the charging roll 2Y.

The photoreceptor cleaning device 6Y has a cleaning blade which contacts with the surface of the photoreceptor 1Y. The cleaning blade is, for example, configured with an elastic material, and examples of the elastic material include thermosetting polyurethane rubber, silicone rubber, fluororubber, and ethylene-propylene-diene rubber. A contact pressure of the cleaning blade is, for example, 1.0 gf/mm to 5.0 gf/mm. A contact width of the cleaning blade (contact length along a rotation direction of the photoreceptor) is, for example, 0.5 mm to 2.0 mm. A contact angle of the cleaning blade is, for example, 5° to 30°.

The primary transfer roll 5Y is disposed inside the intermediate transfer belt 20 to be provided at a position opposed to the photoreceptor 1Y. Furthermore, bias supplies (not shown) that apply a primary transfer bias are connected to the primary transfer rolls 5Y, 5M, 5C, and 5K of each unit, respectively. Each bias supply changes a value of a transfer bias that is applied to each primary transfer roll under the control of a controller (not shown).

Hereinafter, an operation of forming a yellow image in the first unit 10Y will be described.

First, before the operation, the surface of the photoreceptor 1Y is charged to a potential of −600 V to −800 V by the charging roll 2Y.

The photoreceptor 1Y is formed by laminating a photosensitive layer on a conductive (for example, volume resistivity at 20° C.: $1\times10^{-6}$ Ωcm or less) substrate. The photosensitive layer typically has high resistance (that is about the same as the resistance of a general resin), but has properties in which when laser beams are applied, the specific resistance of a part irradiated with the laser beams changes. Accordingly, the laser beams 3Y are output to the charged surface of the photoreceptor 1Y from the exposure device 3 in accordance with image data for yellow sent from the controller (not shown). Thus, an electrostatic charge image of a yellow image pattern is formed on the surface of the photoreceptor 1Y.

The electrostatic charge image is an image that is formed on the surface of the photoreceptor 1Y by charging, and is a so-called negative latent image, that is formed by irradiating the photosensitive layer with laser beams 3Y so that the specific resistance of the irradiated part is lowered to cause charges to flow on the surface of the photoreceptor 1Y, while charges stay on a part which is not irradiated with the laser beams 3Y.

The electrostatic charge image formed on the photoreceptor 1Y is rotated up to a predetermined developing position with the travelling of the photoreceptor 1Y. The electrostatic charge image on the photoreceptor 1Y is developed and visualized as a toner image at the developing position by the developing device 4Y.

The developing device 4Y contains, for example, an electrostatic charge image developer including at least a yellow toner and a carrier. The yellow toner is frictionally charged by being agitated in the developing device 4Y to have a charge with the same polarity (negative polarity) as the charge that is on the photoreceptor 1Y, and is thus held on the developer roll (an example of the developer holding member). By allowing the surface of the photoreceptor 1Y to pass through the developing device 4Y, the yellow toner electrostatically adheres to the erased latent image part on the surface of the photoreceptor 1Y, so that the latent image is developed with the yellow toner. Next, the photoreceptor 1Y having the yellow toner image formed thereon continuously travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roll 5Y and an electrostatic force toward the primary transfer roll 5Y from the photoreceptor 1Y acts on the toner image, so that the toner image on the photoreceptor 1Y is transferred onto the intermediate transfer belt 20. The transfer bias applied at this time has the opposite polarity (+) to the toner polarity (−), and, for example, is controlled to +10 μA in the first unit 10Y by the controller (not shown).

After the toner image is transferred, the photoreceptor 1Y continues rotating and the toner remaining on the photoreceptor comes into contact with the cleaning blade included in the photoreceptor cleaning device 6Y. The toner remaining on the photoreceptor 1Y is removed and collected by the photoreceptor cleaning device 6Y.

The primary transfer biases that are applied to the primary transfer rolls 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roll 24 contacting the inner surface of the intermediate transfer belt, and a secondary transfer roll (an example of the secondary transfer unit) 26 disposed on the image holding surface side of the intermediate transfer belt 20. Meanwhile, a recording sheet (an example of the recording medium) P is supplied to a gap between the secondary transfer roll 26 and the intermediate transfer belt 20, that contact with each other, via a supply mechanism at a predetermined timing, and a secondary transfer bias is applied to the support roll 24. The transfer bias applied at this time has the same polarity (−) as the toner polarity (−), and an electrostatic force toward the recording sheet P from the intermediate transfer belt 20 acts on the toner image, so that the toner image on the intermediate transfer belt 20 is transferred onto the recording sheet P. In this case, the secondary transfer bias is determined depending on the resistance detected by a resistance detector (not shown) that detects the resistance of the secondary transfer part, and is voltage-controlled.

Thereafter, the recording sheet P is fed to a pressure-contacting part (nip part) between a pair of fixing rolls in a fixing device (an example of the fixing unit) 28 so that the toner image is fixed to the recording sheet P, so that a fixed image is formed.

Examples of the recording sheet P onto which a toner image is transferred include plain paper that is used in electrophotographic copying machines, printers, and the like. As a recording medium, an OHP sheet is also exemplified other than the recording sheet P.

The surface of the recording sheet P is preferably smooth in order to further improve smoothness of the image surface after fixing. For example, coated paper obtained by coating a surface of plain paper with a resin or the like, art paper for printing, and the like are preferably used.

The recording sheet P on which the fixing of the color image is completed is discharged toward a discharge part, and a series of the color image forming operations ends.

Process Cartridge

A process cartridge according to the exemplary embodiment will be described.

The process cartridge according to the exemplary embodiment is provided with a developing unit that contains the electrostatic charge image developer according to the exemplary embodiment and develops an electrostatic charge image formed on a surface of an image holding member with the electrostatic charge image developer to form a toner image, and is detachable from an image forming apparatus.

The process cartridge according to the exemplary embodiment is not limited to the above-described configuration, and may be configured to include a developing unit, and if necessary, at least one selected from other units such as an image holding member, a charging unit, an electrostatic charge image forming unit, and a transfer unit.

Hereinafter, an example of the process cartridge according to the exemplary embodiment will be shown. However, the process cartridge is not limited thereto. Major parts shown in the drawing will be described, but descriptions of other parts will be omitted.

Figure 2:
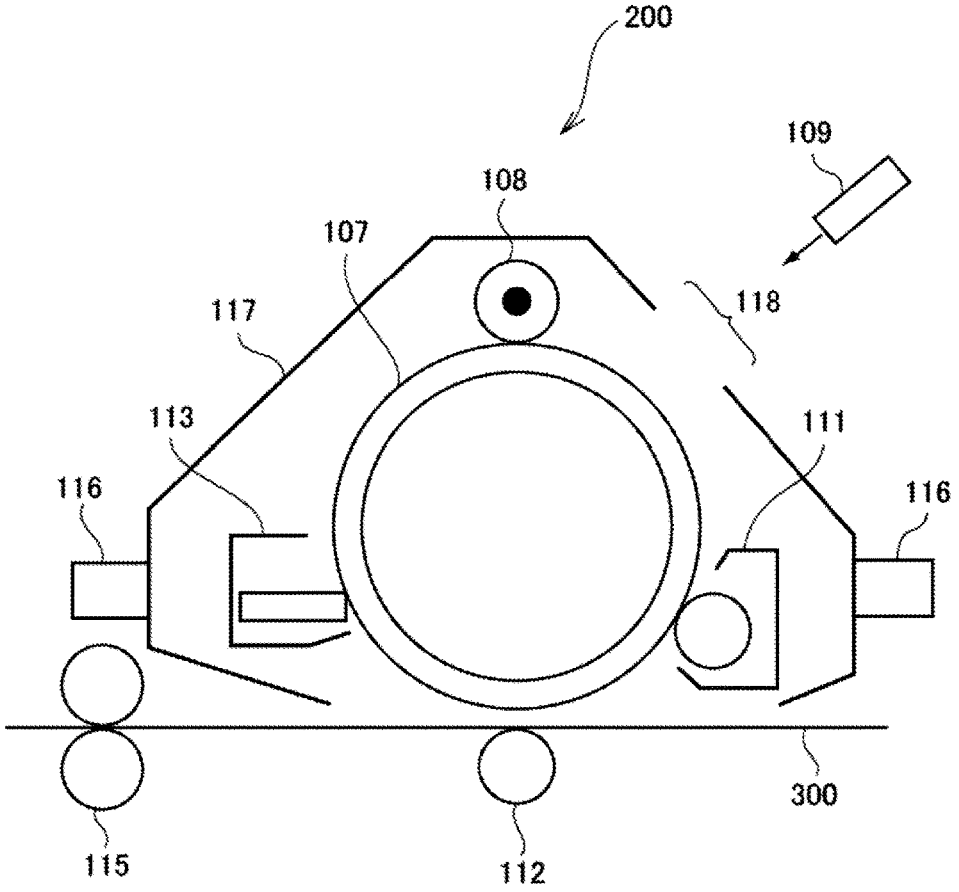
FIG. 2 is a schematic configuration diagram showing an example of a process cartridge detachable from an image forming apparatus according to the exemplary embodiment.

FIG. 2 is a schematic diagram showing a configuration of the process cartridge according to the exemplary embodiment.

A process cartridge 200 shown in FIG. 2 is formed as a cartridge having a configuration in which a photoreceptor 107 (an example of the image holding member), and a charging roll 108 (an example of the charging unit), a developing device 111 (an example of the developing unit), and a photoreceptor cleaning device 113 (an example of the cleaning unit), which are provided around the photoreceptor 107, are integrally combined and held by the use of, for example, a housing 117 provided with a mounting rail 116 and an opening 118 for exposure. The charging roll 108, for example, contacts with a circumference surface of the photoreceptor 107 to charge the circumference surface of the photoreceptor 107. The photoreceptor cleaning device 113 includes a blade that contacts with the photoreceptor 107.

The process cartridge 200 may include a contact-type charger such as a charge brush, a charge film, a charge rubber blade, or a charge tube or a non-contact type charger such as a scoroton charger or a corotron charger, instead of the charging roll 108.

In FIG. 2, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

EXAMPLES

Hereinafter, the exemplary embodiment of the invention will be described in detail using examples, but the exemplary embodiment of the invention is not limited to the examples. In the following descriptions, "parts" are based on weight, unless specifically noted.

Preparation of Toner Particles

Preparation of Amorphous Resin Particle Dispersion

Terephthalic acid: 30 parts by mol

Fumaric acid: 70 parts by mol

Ethylene oxide 2 mol adduct of Bisphenol A: 20 parts by mol

Propylene oxide 2 mol adduct of Bisphenol A: 80 parts by mol

The above materials are put in a reaction vessel provided with a stirrer, a nitrogen gas introducing tube, a temperature sensor, and a rectifying column. Then, the temperature is increased to 190° C. over 1 hour, and 1.2 parts of dibutyl tin oxide is added to 100 parts of the above material. The temperature is increased to 240° C. over 6 hours while distilling away generated water, a dehydration condensation reaction is continued for 3 hours while maintaining the temperature at 240° C., and then the reactant is cooled.

The reactant in a melted state is transferred to CAVITRON CD1010 (manufactured by Eurotec Ltd.) at a rate of 100 g per minute. At the same time, separately prepared ammonia water having a concentration of 0.37% by weight is transferred to CAVITRON CD1010 at a rate of 0.1 liters per min, while being heated at 120° C. by a heat exchanger. CAVITRON CD1010 is operated under the conditions of a rotation rate of a rotor of 60 Hz and pressure of 5 kg/cm$^2$, and a resin particle dispersion in which resin particles having a volume average particle diameter of 160 nm are dispersed is obtained. Ion exchange water is added to the resin particle dispersion to adjust a solid content to 20% by weight, and thus, an amorphous resin particle dispersion is obtained.

Preparation of Crystalline Resin Particle Dispersion

Dodecanedioic acid: 100 parts by mol 1,12-dodecane diol: 100 parts by mol

The above materials are put in a reaction vessel provided with a stirrer, a nitrogen gas introducing tube, a temperature sensor, and a rectifying column. Then, the temperature is increased to 160° C. over 1 hour, and 0.02 parts of dibutyl tin oxide is added to 100 parts of the above material. The temperature is increased to 200° C. over 6 hours while distilling away generated water, a dehydration condensation reaction is continued for 4 hours while maintaining the temperature at 200° C., and then the reactant is cooled. After cooling, solid-liquid separation is performed, a solid material is dried, and thus, a crystalline polyester resin is obtained.

Crystalline polyester resin: 50 parts

Anionic surfactant (NEOGEN SC manufactured by DKS Co., Ltd.): 2 parts

Ion exchange water: 200 parts

The above components are mixed with each other, heated to 120° C., and dispersed by using a homogenizer (ULTRA TURRAX T50 manufactured by IKA Works, Inc.), and dispersion treatment is performed by using a pressure discharge type homogenizer. When the volume average particle diameter becomes 160 nm, the dispersion is collected, and thus, a crystalline resin particle dispersion having a solid content of 20% by weight is obtained.

Preparation of Colorant Dispersion

C.I. Pigment Blue 15:3 (manufactured by Dainichiseika Color & Chemicals Mfg. Co., Ltd.): 70 parts Anionic surfactant (NEOGEN RK manufactured by DKS Co., Ltd.): 5 parts Ion exchange water: 200 parts The above materials are mixed with each other, and dispersed for 10 minutes by using a homogenizer (ULTRA TURRAX T50 manufactured by IKA Works, Inc.). Ion exchange water is added so that a solid content in the dispersion becomes 20% by weight, and thus, a colorant dispersion in which colorant particles having a volume average particle diameter of 170 nm are dispersed is obtained.

Preparation of Release Agent Dispersion

Paraffin Wax (HNP-9 manufactured by Nippon Seiro Co., Ltd.): 50 parts

Anionic surfactant (NEOGEN RK manufactured by DKS Co., Ltd.): 1 part

Ion exchange water: 200 parts

The above materials are mixed with each other, heated to 95° C., and dispersed using a homogenizer (ULTRA TURRAX T50 manufactured by IKA Works, Inc.). After that, the mixture is subjected to dispersion treatment with MANTON-GAULIN HIGH PRESSURE HOMOGENIZER (manufactured by Gaulin Co., Ltd.), and thus, a release agent dispersion (solid content of 20% by weight) in which release agent particles are dispersed is obtained. A volume average particle diameter of the release agent particles is 180 nm.

Preparation of Toner Particles

Amorphous resin particle dispersion (solid content of 20% by weight): 150 parts

Crystalline resin particle dispersion (solid content of 20% by weight): 50 parts Colorant dispersion (solid content of 20% by weight): 25 parts Release agent dispersion (solid content of 20% by weight): 40 parts Anionic surfactant (NEOGEN RK manufactured by DKS Co., Ltd.): 1 part Ion exchange water: 100 parts The above materials are put in a reaction vessel provided with a thermometer, a pH meter, and a stirrer, and heated to 30° C. with a mantle heater from the outside, and maintained for 30 minutes while stirring at a rotation rate of 150 rpm. 0.3 N nitric acid aqueous solution is added to adjust pH to 3.0, and then, 3 weight % polyaluminum chloride aqueous solution is added while dispersing the mixture using a homogenizer (ULTRA TURRAX T50 manufactured by IKA Works, Inc.). The dispersion is heated to 50° C. while stirring and maintained for 30 minutes. 70 parts of amorphous resin particle dispersion is added, maintained for 1 hour, 0.1 N sodium hydroxide aqueous solution is added to adjust pH to 8.5, the mixture is heated to 85° C. while continuing stirring and maintained for 5 hours. Cooling, solid-liquid separation, washing and drying of solid contents are sequentially performed and thus, toner particles having a volume average particle diameter of 4.8 μm are obtained.

Preparation of Silica Particles Surface-Treated with Silicone Oil $SiCl_4$, hydrogen gas, and oxygen gas are mixed with each other in a mixing chamber of a combustion burner, combusted at a temperature of 1,000° C. to 3,000° C., and silica powder is taken out from gas after combustion, and thereby silica particles are obtained. At this time, a molar ratio of hydrogen gas and oxygen gas is set as 2:1. 300 parts of toluene and 1 part of dimethyl silicone oil (KF96 manufactured by Shin-Etsu Chemical Co., Ltd., 50 $mm^2/s$) are added to 10 parts of the obtained silica particles, ultrasonic waves are applied, the mixture are stirred at room temperature for 30 minutes, concentrated and dried, and thermally dried at 200° C. for 3 hours, to obtain silica particles surface-treated with silicone oil. When a number average particle diameter thereof in a state of being externally added to the toner particles is measured, the number average particle diameter of the silica particles surface-modified with silicone oil is 40 nm.

Preparation of Hydrophobic Silica Particles (Silica Particles not-Modified with Silicone Oil)

Preparation of Hydrophobic Silica Particles (1)

300 parts of methanol and 49.4 parts of 10% ammonia water are put into a glass reaction vessel having a volume of 3 L provided with a metal stirring rod, a dripping nozzle (microtube pump manufactured by Teflon (registered trademark)), and a thermometer, and stirred and mixed to obtain an alkali catalyst solution. The temperature of the alkali catalyst solution is adjusted to 25° C. and the alkali catalyst solution is subjected to nitrogen substitution. While stirring the alkali catalyst solution, 450 parts of tetramethoxysilane (TMOS) and 270 parts of ammonia water having a catalyst ($NH_3$) concentration of 4.44% are added dropwise at the same time at the following supply rate to obtain a silica particle suspension. Here, the supply rate of TMOS is 3.3 parts/min and the supply rate of 4.44% ammonia water is 1.98 parts/min.

Next, the obtained silica particle suspension is dried by spray drying to remove a solvent and powder of hydrophilic silica particles is obtained. 100 parts of the obtained powder of hydrophilic silica particles is added into a mixer and stirred at 200 rpm while heated to 200° C. under the nitrogen atmosphere, and 30 parts of hexamethyldisilazane is added dropwise to the powder of the hydrophilic silica particles to cause a reaction for 2 hours. The resultant material is cooled to obtain hydrophobic silica particles (1). When the number average particle diameter and the shape factor SF2 thereof in a state of being externally added to the toner particles are measured, the number average particle diameter of the hydrophobic silica particles (1) is 140 nm and the shape factor SF2 thereof is 110.

Preparation of Hydrophobic Silica Particles (2)

Hydrophobic silica particles (2) are obtained in the same manner as in the preparation of the hydrophobic silica particles (1), except for changing the amount of 10% ammonia water to 48.2 parts, changing the supply rate of TMOS to 4.25 parts/min, and changing the supply rate of 4.44% ammonia water to 2.55 parts/min. When the number average particle diameter and the shape factor SF2 thereof in a state of being externally added to the toner particles are measured, the number average particle diameter of the hydrophobic silica particles (2) is 90 nm and the shape factor SF2 thereof is 115.

Preparation of Hydrophobic Silica Particles (3)

Hydrophobic silica particles (3) are obtained in the same manner as in the preparation of the hydrophobic silica particles (1), except for changing the amount of 10% ammonia water to 50.5 parts, changing the supply rate of TMOS to 4.25 parts/min, and changing the supply rate of 4.44% ammonia water to 2.55 parts/min. When the number average particle diameter and the shape factor SF2 thereof in a state of being externally added to the toner particles are measured, the number average particle diameter of the hydrophobic silica particles (3) is 190 nm and the shape factor SF2 thereof is 115.

Preparation of Carrier

Ferrite Particles (Mn—Mg—Sr ferrite, volume average particle diameter of 20 μm): 100 parts Toluene: 14 parts Perfluorooctyl methyl acrylate-methyl methacrylate copolymer (copolymerization ratio (weight ratio) of 20:80): 2 parts Carbon black (R330 manufactured by Cabot Corporation): 0.2 parts The above materials except for the ferrite particles are dispersed in a sand mill to prepare a dispersion. This dispersion is put into a vacuum degassing type kneader together with the ferrite particles, the pressure is reduced while stirring to distil toluene to prepare a resin coated carrier. The resin coating carrier is classified by using a wind classifier to prepare a resin coating carrier having a volume average particle diameter of 20 μm.

The volume average particle diameter of the ferrite particles used in the preparation of the resin coating carrier is changed and, if necessary, the carrier is classified by using a wind classifier, to prepare resin coating carriers having volume average particle diameters of 27 μm, 30 μm, and 35 μm, respectively.

Preparation of Developer

Examples 1 to 14 and Comparative Examples 1 to 22

The silica particles surface-modified with silicone oil and any of hydrophobic silica particles (1) to (3) are added in amounts shown in Table 1 to 100 parts of the toner particles, and mixed at a rotation rate of 10,000 rpm for 30 seconds by using a sample mill. The mixture was sieved with a vibrating sieve having an aperture of 45 μm to obtain an externally added toner. The externally added toner and the carrier shown in Table 1 are put in a V blender at a weight ratio of 8:92, agitated and mixed for 20 minutes. The resultant material is sieved with a sieve having an aperture of 212 μm to obtain a developer.

Quantitation of Elemental Silicon on Surface of Carrier

The toner is blown off from the developer to isolate the carrier. An electron state of silicon is measured by using an X-ray photoelectron spectroscopic device (PHI 5000 VERSA PROBE II manufactured by ULVAC-PHI, Inc., type of X ray: AL Monochromator ray, X-ray output: 25 W, 15 kV) by using the isolated carrier as a sample, to obtain Si2p spectra. The area strength of each peak appeared in Si2p spectra is determined and a value of {area strength of peak derived from silicone oil/area strength of peak derived from silica} is determined.

Image Evaluation

The developers of Examples and Comparative Examples are loaded on the image forming apparatus, and images are formed to evaluate formation or non-formation of streaks (color streaks and white streaks) extending in a transporting direction of a recording medium. The results are shown in Table 1.

In the following image forming, an image density is kept low in order to cause streaky image defects to be more easily formed. When the image density is low, the toner in the developer is less replaced, and accordingly, the external additive frequently receives an external force from the carrier and highly tends to be embedded in the toner particles.

Streaky Image Defects (1)

AP-V C7775 manufactured by Fuji Xerox Co., Ltd. is prepared as an image forming apparatus. The image forming apparatus includes a charging roll which is a contact type charging device and a photoreceptor cleaning blade formed of thermosetting polyurethane rubber. A voltage obtained by superimposing an AC voltage on a DC voltage is applied to the charging roll and an image having an image density of 1.5% is continuously printed by using this image forming apparatus on A3-sized sheets under the environment of a temperature of 23° C. and relative humidity of 50%. The printed images are visually observed and degrees of formation of streaks are classified as described below.

A: No streaks are formed on first to 15,000th sheets.
B: Streaks are formed on 12,501st to 15,000th sheets.
C: Streaks are formed on 10,001st to 12,500th sheets.
D: Streaks are formed on 5,001st to 10,000th sheets.
E: Streaks are formed on first to 5,000th sheets.

Streaky Image Defects (2)

Images are formed in the same manner as in the image forming in "Streaky Image Defects (1)", except for applying only the DC voltage to the charging roll. The printed images are visually observed and degrees of formation of streaks are classified as described below.

A: No streaks are formed on first to 15,000th sheets.
B: Streaks are formed on 12,501st to 15,000th sheets.
C: Streaks are formed on 10,001st to 12,500th sheets.
D: Streaks are formed on 5,001st to 10,000th sheets.
E: Streaks are formed on first to 5,000th sheets.

Streaky Image Defects (3)

DOCUPRINT CP400d manufactured by Fuji Xerox Co., Ltd. is prepared as an image forming apparatus. The image forming apparatus includes a charging roll which is a contact type charger to which only a DC voltage is applied, and a photoreceptor cleaning blade formed of thermosetting polyurethane rubber. By using this image forming apparatus, an image having an image density of 1.5% is continuously printed on A3-sized sheets under the environment of a temperature of 23° C. and relative humidity of 50%. The printed images are visually observed and degrees of formation of streaks are classified as described below.

A: No streaks are formed on first to 1,500th sheets.
B: Streaks are formed on 1,251st to 1,500th sheets.
C: Streaks are formed on 1,001st to 1,250th sheets.
D: Streaks are formed on 501st to 1,000th sheets.
E: Streaks are formed on first to 500th sheets.

TABLE 1

| | Silica particles surface-treated with silicone oil Amount externally added | Hydrophobic silica particles (1) Amount externally added | Hydrophobic silica particles (2) Amount externally added | Hydrophobic silica particles (3) Amount externally added |
|---|---|---|---|---|
| Comparative Example 1 | — | 2.0 parts | — | — |
| Comparative Example 2 | — | 2.0 parts | — | — |
| Comparative Example 3 | — | 2.0 parts | — | — |
| Comparative Example 4 | — | 2.0 parts | — | — |
| Example 1 | 1.0 part | 2.0 parts | — | — |
| Example 2 | 1.0 part | 2.0 parts | — | — |
| Comparative Example 5 | 1.0 part | 2.0 parts | — | — |
| Comparative Example 6 | 1.0 part | 2.0 parts | — | — |
| Example 3 | 1.5 parts | 2.0 parts | — | — |
| Example 4 | 1.5 parts | 2.0 parts | — | — |
| Comparative Example 7 | 1.5 parts | 2.0 parts | — | — |
| Comparative Example 8 | 1.5 parts | 2.0 parts | — | — |
| Example 5 | 2.0 parts | 2.0 parts | — | — |
| Example 6 | 2.0 parts | 2.0 parts | — | — |
| Example 7 | 2.0 parts | — | 2.0 parts | — |
| Example 8 | 2.0 parts | — | 2.0 parts | — |
| Example 9 | 2.0 parts | — | — | 2.0 parts |
| Example 10 | 2.0 parts | — | — | 2.0 parts |
| Comparative Example 9 | 2.0 parts | 2.0 parts | — | — |
| Comparative Example 10 | 2.0 parts | 2.0 parts | — | — |
| Example 11 | 2.5 parts | 2.0 parts | — | — |
| Example 12 | 2.5 parts | 2.0 parts | — | — |
| Comparative Example 11 | 2.5 parts | 2.0 parts | — | — |
| Comparative Example 12 | 2.5 parts | 2.0 parts | — | — |
| Example 13 | 3.0 parts | 2.0 parts | — | — |
| Example 14 | 3.0 parts | 2.0 parts | — | — |
| Comparative Example 13 | 3.0 parts | 2.0 parts | — | — |
| Comparative Example 14 | 3.0 parts | 2.0 parts | — | — |
| Comparative Example 15 | 3.5 parts | 2.0 parts | — | — |
| Comparative Example 16 | 3.5 parts | 2.0 parts | — | — |
| Comparative Example 17 | 3.5 parts | 2.0 parts | — | — |
| Comparative Example 18 | 3.5 parts | 2.0 parts | — | — |
| Comparative Example 19 | 4.0 parts | — | — | — |
| Comparative Example 20 | 4.0 parts | — | — | — |
| Comparative Example 21 | 4.0 parts | — | — | — |
| Comparative Example 22 | 4.0 parts | — | — | — |

TABLE 1-continued

| | Carrier Volume average particle diameter | Quantity ratio of elemental silicon present on surface of carrier (silicone oil-derived/silica-derived) | Streaky image defects (1) | (2) | (3) |
|---|---|---|---|---|---|
| Comparative Example 1 | 20 μm | 0 | D | E | E |
| Comparative Example 2 | 27 μm | | D | E | E |
| Comparative Example 3 | 30 μm | | D | E | E |
| Comparative Example 4 | 35 μm | | D | E | E |
| Example 1 | 20 μm | 0.05 | A | A | A |
| Example 2 | 27 μm | | A | B | B |
| Comparative Example 5 | 30 μm | | A | C | C |
| Comparative Example 6 | 35 μm | | B | C | C |
| Example 3 | 20 μm | 0.10 | A | A | A |
| Example 4 | 27 μm | | A | A | A |
| Comparative Example 7 | 30 μm | | A | B | B |
| Comparative Example 8 | 35 μm | | A | C | C |
| Example 5 | 20 μm | 0.15 | A | A | A |
| Example 6 | 27 μm | | A | A | A |
| Example 7 | 20 μm | | A | B | B |
| Example 8 | 27 μm | | A | A | A |
| Example 9 | 20 μm | | A | B | B |
| Example 10 | 27 μm | | A | A | A |
| Comparative Example 9 | 30 μm | | A | B | B |
| Comparative Example 10 | 35 μm | | A | C | C |
| Example 11 | 20 μm | 0.18 | A | A | A |
| Example 12 | 27 μm | | B | A | A |
| Comparative Example 11 | 30 μm | | C | B | B |
| Comparative Example 12 | 35 μm | | C | C | C |
| Example 13 | 20 μm | 0.20 | B | A | A |
| Example 14 | 27 μm | | B | B | B |
| Comparative Example 13 | 30 μm | | C | C | C |
| Comparative Example 14 | 35 μm | | C | C | C |
| Comparative Example 15 | 20 μm | 0.25 | D | D | D |
| Comparative Example 16 | 27 μm | | E | D | D |
| Comparative Example 17 | 30 μm | | E | E | E |
| Comparative Example 18 | 35 μm | | E | E | E |
| Comparative Example 19 | 20 μm | 0.30 | E | E | E |
| Comparative Example 20 | 27 μm | | E | E | E |
| Comparative Example 21 | 30 μm | | E | E | E |
| Comparative Example 22 | 35 μm | | E | E | E |

In the examples, formation of streaky image defects is prevented, in the initial stage of the image forming and even in a case where the image forming is repeated, in comparison to the comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developer comprising:

toner particles;

silica particles treated with a silicone oil, which are externally added to the toner particles; and a carrier, wherein a volume average particle diameter of the carrier is in a range of 20 μm to 27 μm, a quantity ratio of an elemental silicon derived from a silicone oil and an elemental silicon derived from silica which are present on the surface of the carrier (silicone oil-derived elemental silicon/silica-derived elemental silicon) is in a range of 0.05 to 0.2, and the silicone oil is at least one selected from the group consisting of dialkyl polysiloxane, phenyl-modified polysiloxane and fluoroalkyl-modified polysiloxane.

2. The electrostatic charge image developer according to claim 1, further comprising:

second silica particles having a number average particle diameter of 50 nm to 200 nm.

3. The electrostatic charge image developer according to claim 1, wherein a volume average particle diameter of the toner particles is in a range of 3.8 μm to 5.0 μm.

4. The electrostatic charge image developer according to claim 1, wherein the quantity ratio of the silicone oil-derived elemental silicon and the silica-derived elemental silicon which are present on the surface of the carrier (silicone oil-derived/silica-derived) is in a range of 0.05 to 0.18.

5. The electrostatic charge image developer according to claim 2, wherein a weight ratio of the silica particles treated with a silicone oil to the second silica particles is in a range of 4:1 to 1:4.

6. The electrostatic charge image developer according to claim 2, wherein a weight ratio of the silica particles treated with a silicone oil to the second silica particles is in a range of 3:2 to 2:3.

7. A process cartridge that is detachable from an image forming apparatus, comprising:

a developing unit that contains the electrostatic charge image developer according to claim 1 and develops an electrostatic charge image formed on a surface of an image holding member with the electrostatic charge image developer as a toner image.

8. An image forming apparatus comprising:

an image holding member;

a charging member that charges a surface of the image holding member;

an electrostatic charge image forming unit that forms an electrostatic charge image on a charged surface of the image holding member;

a developing unit that contains the electrostatic charge image developer according to claim 1 and develops the electrostatic charge image formed on the surface of the image holding member with the electrostatic charge image developer as a toner image;

a transfer member that transfers the toner image formed on the surface of the image holding member to a surface of a recording medium;

a fixing unit that fixes the toner image transferred on the surface of the recording medium; and a cleaning unit that has a blade that contacts with the surface of the image holding member and cleans the surface of the image holding member with the blade after the toner image is transferred onto the surface of the recording medium.

9. The image forming apparatus according to claim 8, wherein the electrostatic charge image developer further includes second silica particles having a number average particle diameter of 50 nm to 200 nm.

10. The image forming apparatus according to claim 8, wherein a volume average particle diameter of toner particles of the electrostatic charge image developer is in a range of 3.8 μm to 5.0 μm.

11. The image forming apparatus according to claim 8, wherein a quantity ratio of silicone oil-derived elemental silicon and the silica-derived elemental silicon which are present on a surface of a carrier of the electrostatic charge image developer (silicone oil-derived/silica-derived) is in a range of 0.05 to 0.18.

12. The image forming apparatus according to claim 8, wherein a weight ratio of the silica particles treated with a silicone oil to the second silica particles of the electrostatic charge image developer is in a range of 4:1 to 1:4.

13. The image forming apparatus according to claim 8, wherein a weight ratio of the silica particles treated with a silicone oil to the second silica particles of the electrostatic charge image developer is in a range of 3:2 to 2:3.

* * * * *